US010494982B2

(12) United States Patent
Lyons

(10) Patent No.: US 10,494,982 B2
(45) Date of Patent: Dec. 3, 2019

(54) HARDWARE PROTECTION MODE IN HIGH AMBIENT TEMPERATURE AFTER STATIONARY OPERATION

(71) Applicant: International Engine Intellectual Property Company, LLC, Lisle, IL (US)

(72) Inventor: Timothy M. Lyons, Batavia, IL (US)

(73) Assignee: International Engine Intellectual Property Company, LLC, Lisle, IL (US)

( * ) Notice: Subject to any disclaimer, the term of this patent is extended or adjusted under 35 U.S.C. 154(b) by 9 days.

(21) Appl. No.: 15/884,757

(22) Filed: Jan. 31, 2018

(65) Prior Publication Data

US 2019/0234288 A1 Aug. 1, 2019

(51) Int. Cl.

*F01P 7/08* (2006.01)
*F02N 11/08* (2006.01)
*F02M 26/16* (2016.01)

(52) U.S. Cl.

CPC ..... *F01P 7/081* (2013.01); *F02M 26/16* (2016.02); *F02N 11/0825* (2013.01); *F01P 2025/13* (2013.01); *F01P 2025/62* (2013.01); *F01P 2031/30* (2013.01)

(58) Field of Classification Search

CPC .... F01P 7/081; F01P 7/02; F01P 7/026; F01P 7/08; F01P 7/082; F01P 2025/13; F01P 2025/62; F01P 2025/66; F01P 2025/12; F01P 2025/30; F01P 2025/31; F01P 2025/33; F01P 2025/46; F01P 2025/48; F01P 2025/64; F02N 11/0825

See application file for complete search history.

(56) References Cited

U.S. PATENT DOCUMENTS 3,894,521 A * 7/1975 Sakasegawa ..... F01P 5/04 123/41.12
2009/0164048 A1* 6/2009 Kyuma ..... F01P 7/08 700/275

* cited by examiner

*Primary Examiner* — Jacob M Amick
(74) *Attorney, Agent, or Firm* — Jack D. Nims; Jeffrey P. Calfa; Mark C. Bach

(57) ABSTRACT

A system and method for dissipating vehicle under hood heat accumulated during stationary engine operation at high load or RPM and/or under high temperature ambient conditions is installed in a vehicle having an engine positioned within an engine compartment, and a cooling fan selectively driven by way of a fan clutch. The system includes a controller connected to the engine and to the fan clutch. The controller determines whether the period of stationary engine operation occurs at or above a threshold engine load or RPM, at or above a threshold engine operating temperature, at or above a threshold ambient temperature, and/or for or longer than a threshold stationary engine operation duration. If so, the at least one controller increases a low idle set point of the engine and commands the fan clutch to engage or remain engaged for a cool-down period following the period of stationary engine operation.

20 Claims, 2 Drawing Sheets

HARDWARE PROTECTION MODE IN HIGH AMBIENT TEMPERATURE AFTER STATIONARY OPERATION

BACKGROUND

Field of Invention

Figure 1A:
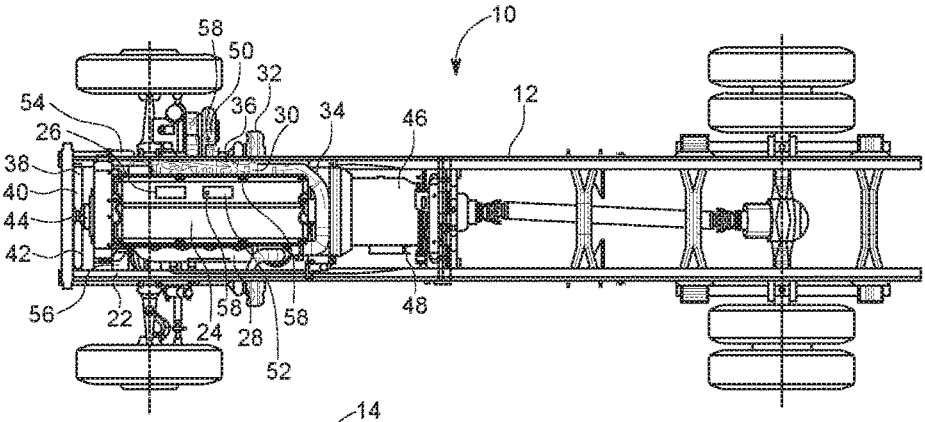

Embodiments described herein generally relate to a system and method for dissipating vehicle under hood heat accumulated during stationary engine operation at high load or revolutions per minute (RPM), increased engine operating temperature, increased individual component temperature, increased coolant temperature, and/or under high temperature ambient conditions.

Related Art

The engine of a vehicle, such as a vocational truck, an emergency vehicle, an industrial vehicle, an agricultural vehicle, and the like, is often used to provide power while the vehicle is stationary, for example using a Power Take-Off (PTO). Other vehicles may provide stationary power from the engine by way of a generator or by way of a hydraulic pump, for example in a hybrid vocational truck. Examples of vehicle applications requiring stationary power may include a water pump on a fire truck, a hydraulic operated compactor on a garbage truck, a hydraulic operated mechanical arm on a bucket truck, a mechanical winch on a tow truck, a cement mixer on a cement truck, and the like, Sometimes the need for stationary power may require extended stationary operation under high engine load or RPM and may occur during high ambient temperatures. As a result, very high under hood temperatures may occur.

During the actual stationary operation, the engine fan and cooling system of the vehicle mitigates under hood temperatures by rejecting engine heat to the environment by way of the radiator of the cooling system and by way of cycling of ambient air through the engine compartment. However, if the engine is operated at a relatively high load or RPM during stationary operation, and then immediately shut off, i.e.—shut off within about one minute or less, the engine can undergo a condition called heat-soak, wherein heat rejected to the cylinders during combustion is no longer removed by the cooling system, and ultimately is transmitted to the under hood environment. Furthermore, certain engine accessories and sub-systems may continue to reject heat to the under hood environment, which would have been removed during operation by way of ambient air being cycled through the engine compartment. For example, the engine turbocharger is often a source of significant under hood heat, along with the exhaust gas recirculation cooler and other components of the Exhaust Gas Recirculation (EGR) system, as non-limiting examples. Additionally, if the vehicle is equipped with cab air conditioning, heat from the air conditioning condenser may continue to reject heat to the under hood environment.

All of this residual heat continues to accumulate in the engine compartment for a period of time after engine shutdown. This, combined with high ambient temperature conditions, may cause certain vehicle and engine components to exceed their temperature limits. One engine component that may be subject to failure due to residual heat accumulation following engine shutdown under high ambient temperature conditions and following extended high load or RPM stationary operation, is the Exhaust Gas Recirculation Valve (EGRV). The EGRV is a valve that controls the amount of exhaust gas that is allowed to recirculate through the EGR system back into the engine intake for emission control purposes. Failure of the EGRV due to residual heat accumulation in the engine compartment may lead to expensive replacement of the EGRV under warranty. Other examples of engine components that may be subject to failure due to residual heat accumulation following engine shutdown may include the turbocharger actuator and the Engine Control Unit (ECU).

Accordingly, there is an unmet need for a system and method for dissipating vehicle under hood heat accumulated during stationary engine operation at high load or RPM, increased engine operating temperature, increased individual component temperature, increased coolant temperature, and/or under high temperature ambient conditions, in order to prevent engine component failure due to excessive temperature.

SUMMARY

Embodiments described herein relate to such a system and method for dissipating vehicle under hood heat accumulated during stationary engine operation at high load or revolutions per minute (RPM and/or under high temperature ambient conditions, which may be embodied as a hardware protection mode. The system and method described herein may be applied to various types of vehicles used to provide stationary engine power, such as vocational trucks, emergency vehicles, industrial vehicles, and agricultural vehicles, as non-limiting examples.

A non-limiting exemplary embodiment of a system and method for dissipating vehicle under hood heat accumulated during stationary engine operation at high load or RPM, increased engine operating temperature, increased individual component temperature, increased coolant temperature, and/or under high temperature ambient conditions utilizes an extended or prolonged cool-down period following a period of sustained stationary engine operation at high engine load or RPM, increased engine operating temperature, increased individual component temperature, increased coolant temperature, and/or high ambient temperatures. This extended or prolonged cool-down period may include increasing the low idle set point of the engine to an increased value, for example 800 to 1000 RPM for a diesel engine. The increased low idle set point may be programmable and/or re-programmable, so the increased set point may be altered by the operator, by a mechanic, or by remote communication, or may be fixed by the vehicle or engine manufacturer. Further, the length of the extended or prolonged cool-down period may also be programmable and/or re-programmable, so that the length of the extended or prolonged cool-down period, which may for example be between one and five minutes, may also be altered by the operator, by a mechanic, or by remote communication, or may be fixed by the vehicle or engine manufacturer. Additionally, the threshold values indicating engine operation at high engine load or RPM, increased engine operating temperature, increased individual component temperature, increased coolant temperature, and/or high ambient temperatures, and/or the duration of stationary engine operation, that trigger the extended or prolonged cool-down period may be programmable and/or re-programmable, so that the threshold values may be altered by the operator, by a mechanic, or by remote communication, or may be fixed by the vehicle or engine manufacturer.

During the extended or prolonged cool-down period, the system and method may further command the engine cooling fan clutch to engage or remain engaged, thereby overriding any disengagement of the engine cooling fan clutch that would otherwise take place. Further, the system and method may ignore or override any engine off key switch command for a programmable and/or re-programmable length of time, which may be the same as or different from the programmable and/or re-programmable length of the extended or prolonged cool-down period itself. Again, the programmable and/or re-programmable length of time that the system and method ignores or overrides any engine off key switch command may therefore be altered by the operator, by a mechanic, or by remote communication, or may be fixed by the vehicle or engine manufacturer. Additionally, the override of the engine off key switch command may be deactivated by the system and method in the presence of a high risk or priority engine fault, such as low oil pressure, coolant loss, or an open hood, as non-limiting examples. The non-limiting exemplary embodiment of the system and method for dissipating vehicle under hood heat accumulated during stationary engine operation at high load or RPM and/or under high temperature ambient conditions may be implemented using one or more controllers, which controller or controllers may also perform control functions of the vehicle engine regular and/or stationary operation.

According to one embodiment of the system and method for dissipating vehicle under hood heat accumulated during stationary engine operation at high load or RPM and/or under high temperature ambient conditions, a vehicle has an engine positioned within an engine compartment, a cooling system that recirculates coolant through the engine and through a radiator, and a cooling fan selectively driven by the engine by way of a cooling fan clutch. At least one controller is connected to the engine and to the cooling fan clutch. The at least one controller is configured to determine whether the period of stationary engine operation occurs at or above a threshold engine load or RPM, at or above a threshold engine operating temperature, at or above a threshold individual component temperature, at or above a threshold coolant temperature, at or above a threshold ambient temperature, and/or for or longer than a threshold stationary engine operation duration. If so, the at least one controller is further configured to increase a low idle set point of the engine and command the cooling fan clutch to engage or remain engaged for a cool-down period following the period of stationary engine operation.

According to another embodiment of the system and method for dissipating vehicle under hood heat accumulated during stationary engine operation at high load or RPM and/or under high temperature ambient conditions, the system is installed in a vehicle having an engine positioned within an engine compartment, and a cooling fan selectively driven by the engine by way of a cooling fan clutch. The system includes at least one controller connected to the engine and to the cooling fan clutch. The at least one controller is configured to determine whether the period of stationary engine operation occurs at or above a threshold engine load or RPM, at or above a threshold engine operating temperature, at or above a threshold individual component temperature, at or above a threshold coolant temperature, at or above a threshold ambient temperature, and/or for or longer than a threshold stationary engine operation duration. If so, the at least one controller is further configured to increase a low idle set point of the engine and command the cooling fan clutch to engage or remain engaged for a cool-down period following the period of stationary engine operation.

According to another embodiment of the system and method for dissipating vehicle under hood heat accumulated during stationary engine operation at high load or RPM and/or under high temperature ambient conditions, a method is implemented on a vehicle having an engine positioned within an engine compartment, and a cooling fan selectively driven by the engine by way of a cooling fan clutch. The method includes several steps. The first step is connecting at least one controller to the engine and to the cooling fan clutch. The second step is configuring the at least one controller to determine whether the period of stationary engine operation occurs at or above a threshold engine load or RPM, at or above a threshold engine operating temperature, at or above a threshold individual component temperature, at or above a threshold coolant temperature, at or above a threshold ambient temperature, and/or for or longer than a threshold stationary engine operation duration. If so, the third step is configuring the at least one controller to increase a low idle set point of the engine and command the cooling fan clutch to engage or remain engaged for a cool-down period following the period of stationary engine operation.

In this way, the system and method for dissipating vehicle under hood heat accumulated during stationary engine operation at high load or RPM, increased engine operating temperature, increased individual component temperature, increased coolant temperature, and/or under high temperature ambient conditions minimizes the intensity and duration of heat soak and under hood heat accumulation following engine shutdown after sustained stationary engine operation at high engine load or RPM. The system and method further dissipates excessive heat from engine accessories and subsystems that would otherwise continue to reject heat to the under hood environment. This avoids exceeding temperature limits of the EGRV, the turbocharger actuator, the ECU, and other sensitive under hood components, reduces warranty costs due to repair and replacement, and improves vehicle uptime.

DESCRIPTION OF TILE DRAWINGS

Figure 1B:
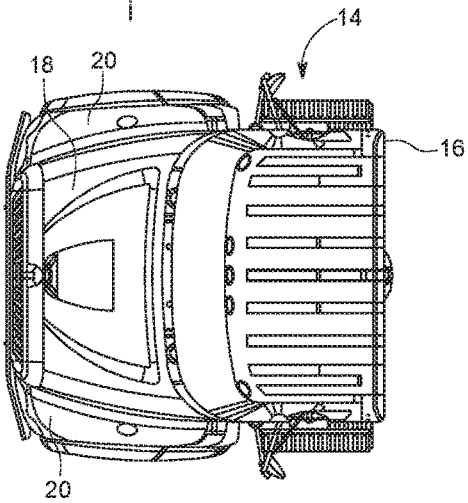
Figure 2:
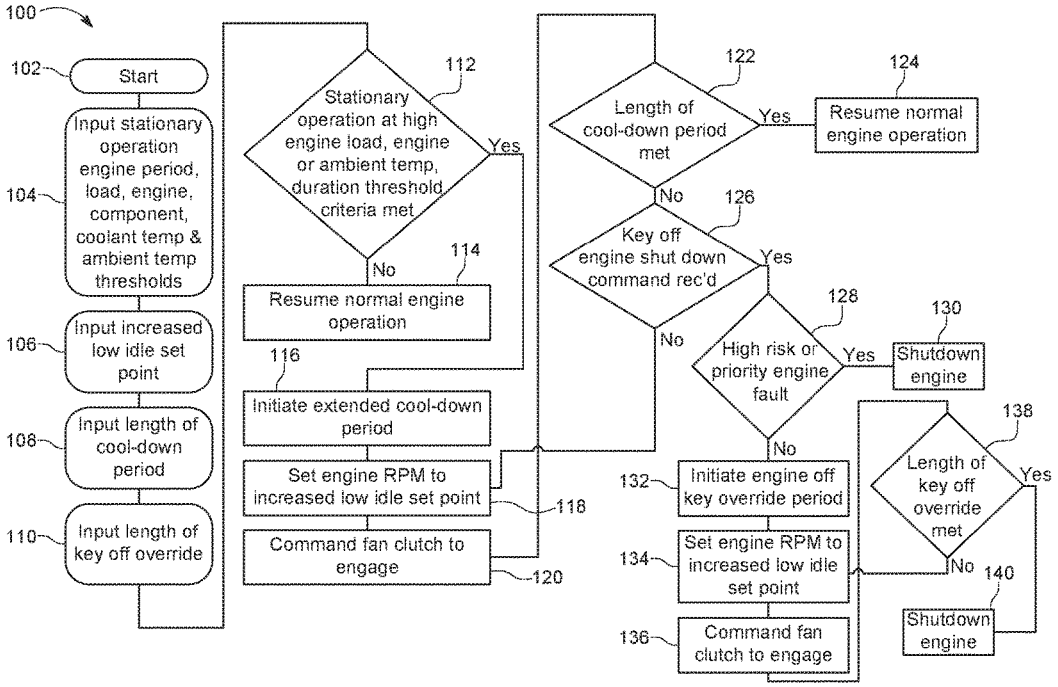

The above-mentioned and other features of embodiments of the system and method for dissipating vehicle under hood heat accumulated during stationary engine operation at high load or RPM, increased engine operating temperature, increased individual component temperature, increased coolant temperature, and/or under high temperature ambient conditions, which may be embodied as a hardware protection mode, will become more apparent and will be better understood by reference to the following description of embodiments of the system and method taken in conjunction with the accompanying drawings, wherein:

FIG. 1A is a plan view of a vehicle chassis assembly having an embodiment of a system and method for dissipating vehicle under hood heat accumulated during stationary engine operation at high load or RPM and/or under high temperature ambient conditions, as described herein;

FIG. 1B is a plan view of a vehicle body having an embodiment of a system and method for dissipating vehicle under hood heat accumulated during stationary engine operations at high load or RPM and/or under high temperature ambient conditions, as described herein; and FIG. 2 is a flowchart diagram of an embodiment of a system and method for dissipating vehicle under hood heat accumulated during stationary engine operation at high load or RPM and/or under high temperature ambient conditions, as described herein.

Corresponding reference numbers indicate corresponding parts throughout the several views. The exemplifications set out herein illustrate embodiments of a system and method for dissipating vehicle under hood heat accumulated during stationary engine operation at high load or RPM, increased engine operating temperature, increased individual component temperature, increased coolant temperature, and/or under high temperature ambient conditions, and such exemplifications are not to be construed as limiting the scope of the claims in any manner.

DETAILED DESCRIPTION

Referring now to FIG. 1A, a plan view of a vehicle chassis assembly 10 having an embodiment of a system and method for dissipating vehicle under hood heat accumulated during stationary engine operation at high load or revolutions per minute (RPM), increased engine operating temperature, increased individual component temperature, increased coolant temperature, and/or under high temperature ambient conditions is shown. The vehicle chassis assembly 10 has a chassis 12 in which an engine 24 and transmission 46 are installed. A body 14 shown in FIG. 1B is attached to the chassis 12, defining a vehicle (not shown) and includes a cabin 16, a hood 18, and fenders 20. The hood 18, the fenders 20, and the forward part of the cabin 16 together form an engine compartment 22 that shelters the engine 24 from the environment and helps to guide airflow over the engine 24. The engine 24 is provided with an air intake system 28 that guides ambient air through a turbocharger 32 into the engine 24 for combustion, and an exhaust system 30 that guides exhaust from the engine 24 through the turbocharger 32 and then discharges the exhaust to the atmosphere. An Exhaust Gas Recirculation (EGR) system 34 allows a certain amount of exhaust gas from the exhaust system 30 to return to the air intake system 28 in order to be recirculated through the engine 24, for the purpose of reducing unwanted exhaust emission byproducts. The amount of exhaust gas that is allowed to return to the air intake system 28 is controlled by an Exhaust Gas Recirculation Valve (EGRV) 36. Certain components of the EGR system 34, such as the EGRV 36, along with other under hood components such as the turbocharger actuator 50 that controls the turbocharger 32, or the Engine Control Unit (ECU) 52, if present, may be sensitive to excessively high temperatures within the engine compartment 22.

In order to dissipate waste heat developed by the engine 24, a cooling system 38 recirculates coolant through the engine 24 and through a radiator 40. When the vehicle is in motion, airflow relative to the moving vehicle passes through the radiator 40, thereby removing waste heat from the circulating coolant and therefore from the engine 24. The airflow relative to the moving vehicle then continues to pass through the engine compartment 22, further cooling the engine and other under hood components, including the EGRV 36 and the turbocharger 32. When the vehicle is stopped, airflow may be drawn through the radiator 40 and through the engine compartment 22 by a cooling fan 42, which is selectively driven by the engine 24 by way of a cooling fan clutch 44. The cooling fan clutch 44 may be engaged or disengaged, depending upon the need to draw air through the engine compartment 22 or upon the need to conserve horsepower.

Occasionally, it is necessary to use the engine 24 of the vehicle to provide stationary power, for example by way of a power take-off (PTO) 48. During such stationary engine operation, the engine 24 may need to produce a significant amount of power for the PTO 48 or other load, so that the engine 24 is run at a speed that is higher than a normal idle speed. While the engine 24 is providing stationary power, therefore, the cooling fan 42 may move a sufficient amount of air through the radiator 40 and through the engine compartment 22 to provide the necessary amount of cooling, even under high temperature ambient conditions. However, if the engine 24 of the vehicle is suddenly no longer needed to provide stationary power, the engine 24 of a vehicle not having an embodiment of the system and method for dissipating vehicle under hood heat accumulated during stationary engine operation may then be shut off by the operator immediately after high load or RPM operation, resulting in heat-soak of the engine 24 and continued rejection of unwanted heat from the engine 24, from the turbocharger 32, from the EGR system 34, from the cooling system 38 itself, and from other under hood components into the under hood environment.

In order to prevent damage to the EGRV 36 and other sensitive under hood components, therefore, the system and method for dissipating vehicle under hood heat accumulated during stationary engine operation at high load or RPM, increased engine operating temperature, increased individual component temperature, increased coolant temperature, and/or under high temperature ambient conditions, shown in FIG. 1 and which may be implemented using one or more controllers 26, utilizes an extended or prolonged cool-down period following a period of sustained stationary engine operation under these conditions, as noted previously. The one or more controllers 26 may be connected to the engine 24, to the EGRV 36, to the cooling fan clutch 44, and/or to the PTO 48. The one or more controllers 26 may be integrated with the ECU 52, or may be separate as shown in FIG. 1. The one or more controllers 26 may further be connected to one or more under hood air temperature sensors 56, one or more coolant temperature sensors 54, and/or to one or more under hood individual component temperature sensors 58. Such under hood component temperature sensors 58 may, for non-limiting example, be attached to, integrated with, or internal to the EGRV 36, the turbocharger actuator 50, and/or the ECU 52. Such under hood component temperature sensors 58 may further be separate from and in addition to any coolant temperature sensors 54 of the cooling system 38.

The one or more controllers 26 determine whether the threshold conditions requiring an extended or prolonged cool-down period are met. The one or more controllers 26 may further control the increased low idle of the engine 24 and/or engagement or overriding of any disengagement of the cooling fan clutch 44. The one or more controllers 26 may further control the increased low idle set point, the length of the extended or prolonged cool-down period, the threshold values indicating engine operation at high engine load or RPM, increased engine operating temperature, increased individual component temperature, increased coolant temperature, and/or high ambient temperatures, and/or the duration thereof, that trigger the extended or prolonged cool-down period. The one or more controllers 26 may determine the conditions under which an engine off key switch command is ignored or overridden, as well as the length of time that the engine off key switch command is ignored or overridden.

Turning now to FIG. 2, a flowchart diagram of an embodiment of the system and method for dissipating vehicle under hood heat accumulated during stationary engine operation at high load or RPM, increased engine operating temperature, increased individual component temperature, increased coolant temperature, and/or under high temperature ambient conditions is shown. The controller 26 (not shown in FIG. 2) is configured to take several process steps 100 starting at 102. Steps 104, 106, 108, 110 are optional input steps, and are shown in arbitrary order, so that these optional input steps may occur in any order at this point in the process 100. In first optional input step 104, the one or more controllers 26 receive input from an operator, a mechanic, and/or by remote communication, which input may include the threshold stationary operation engine load or RPM, the threshold engine operating temperature, the threshold individual component temperature, the threshold coolant temperature, the threshold ambient temperature, and/or the duration of stationary engine operation, that will trigger an extended or prolonged cool-down period.

If first optional input step 104 is not part of a given embodiment of the system and method for dissipating vehicle under hood heat accumulated during stationary engine operation, then the threshold stationary operation engine load or RPM, the threshold engine operating temperature, the threshold individual component temperature, the threshold coolant temperature, the threshold ambient temperature, and/or the duration of stationary engine operation that will trigger an extended or prolonged cool-down period may be set or fixed by the vehicle, engine, or controller manufacturer. Alternately, a subset of the threshold stationary operation engine load or RPM, the threshold engine operating temperature, the threshold individual component temperature, the threshold coolant temperature, the threshold ambient temperature, and/or the duration of stationary engine operation that will trigger an extended or prolonged cool-down period may be input by an operator, by a mechanic, and/or by remote communication, and another subset of the threshold stationary operation engine load or RPM, the threshold engine operating temperature, the threshold individual component temperature, the threshold coolant temperature, the threshold ambient temperature, and/or the duration of stationary engine operation may be set or fixed by the vehicle, engine, or controller manufacturer.

In second optional input step 106, the one or more controllers 26 receive input from an operator, a mechanic, or by remote communication, which input may include the increased low idle set point to be utilized during the extended or prolonged cool-down period. If second optional input step 106 is not part of a given embodiment of the system and method for dissipating vehicle under hood heat accumulated during stationary engine operation, then the low idle set point may be set or fixed by the vehicle, engine, or controller manufacturer, for example at 800 to 1000 RPM for a diesel engine. In third optional input step 108, the one or more controllers 26 receive input from an operator, a mechanic, or by remote communication, which input may include the length of the extended or prolonged cool-down period. If third optional input step 108 is not part of a given embodiment of the system and method for dissipating vehicle under hood heat accumulated during stationary engine operation, then the length of the extended or prolonged cool-down period may be set or fixed by the vehicle, engine, or controller manufacturer, for example between one and five minutes.

In fourth optional input step 110, the one or more controllers 26 receive input from an operator, a mechanic, or by remote communication, which input may include the length of time that the system and method for dissipating vehicle under hood heat accumulated during stationary engine operation will ignore or override any engine off key switch command. 1*f* fourth optional input step 110 is not part of a given embodiment of the system and method for dissipating vehicle under hood heat accumulated during stationary engine operation, then the length of time that the system and method for dissipating vehicle under hood heat accumulated during stationary engine operation will ignore or override any engine off key switch command may be set or fixed by the vehicle, engine, or controller manufacturer, and may or may not be fixed to the same value as the length of the extended or prolonged cool-down period itself.

In first decision step 112, the one or more controllers 26 determine whether the threshold stationary operation engine load or RPM, the threshold engine operating temperature, the threshold individual component temperature, the threshold coolant temperature, the threshold ambient temperature, and/or the duration of stationary engine operation that will trigger an extended or prolonged cool-down period have been met following a period of stationary engine operation. If one or more of these conditions have not been met, or if one or more combinations of these conditions have not been met, either as set or fixed within the programming of the one or more controllers 26 by the vehicle, engine, or controller manufacturer, or as input in first optional input step 104, then the one or more controllers 26 cause the engine to resume normal operation at first operation step 114. If one or more of these conditions have been met, or if one or more combinations of these conditions have been met, either as set or fixed within the programming of the one or more controllers 26 by the vehicle, engine, or controller manufacturer, or as input in first optional input step 104, then the one or more controllers 26 initiate the extended or prolonged cool-down period at second operation step 116.

That is to say, the one or more controllers 26 may require only one condition to be met, may require that one or more combinations of conditions to be met, or that one or more conditions be met unless another condition is not met. For non-limiting example, if the threshold stationary operation engine load or RPM and the threshold ambient temperature are both met, but the threshold duration of stationary engine operation is not met, the one or more controllers 26 may determine not to trigger the extended or prolonged cool-down period. For another non-limiting example, if the threshold stationary operation engine load or RPM and the threshold ambient temperature are both met, but the threshold duration of stationary engine operation is not met, yet the threshold engine operating temperature is met, or the threshold individual component temperature is met, or the threshold coolant temperature is met, the one or more controllers 26 may determine to trigger the extended or prolonged cool-down period. Further permutations of conditions or combinations of conditions that will trigger the extended or prolonged cool-down period are contemplated as being within the scope of the system and method for dissipating vehicle under hood heat accumulated during stationary engine operation at high load or RPM, increased engine operating temperature, increased individual component temperature, increased coolant temperature, and/or under high temperature ambient conditions.

The process then proceeds to third operation step 118 wherein the one or more controllers 26 set the engine RPM to the increased low idle set point, either as set or fixed within the programming of the one or more controllers 26 by the vehicle, engine, or controller manufacturer, or as input in second optional input step 106, and then to fourth operation step 120 wherein the one or more controllers 26 command the cooling fan clutch 44 to engage or remain engaged. The process then proceeds to second decision step 122, wherein the one or more controllers 26 determine whether the length of the extended or prolonged cool-down period has been met, either as set or fixed within the programming of the one or more controllers 26 by the vehicle, engine, or controller manufacturer, or as input in third optional input step 108. If the extended or prolonged cool-down period has been met, then the one or more controllers 26 cause the engine to resume normal operation at fifth operation step 124.

If the extended or prolonged cool-down period has not been met, the process then proceeds to third decision step 126 wherein the one or more controllers 26 determine whether an engine off key switch command has been received. If no engine off key switch command has been received, then the one or more controllers 26 continue to set the engine RPM to the increased low idle set point and to command the cooling fan clutch 44 to engage or remain engaged by returning to third operation step 118 and then to fourth operation step 120. If the extended or prolonged cool-down period has not been met at second decision step 122, and if an engine off key switch command has been received at third decision step 126, the process proceeds to fourth decision step 128.

At fourth decision step 128, the one or more controllers 26 determine whether a high risk or priority engine fault, such as low oil pressure, coolant loss, or an open hood, as non-limiting examples, is present, either within the one or more controllers 26 or within another vehicle or engine controller (not shown) with which the one or more controllers 26 are in communication. If a high risk or priority engine fault is present, the process proceeds to sixth operation step 130 wherein the one or more controllers 26 cause the engine to shut down, and the process ends. If no high risk or priority engine fault is present, then the one or more controllers 26 initiate the programmable and/or re-programmable length of time that any engine off key switch command will be ignored or overridden at seventh operation step 132.

The process then proceeds to eighth operation step 134 wherein the one or more controllers 26 set the engine RPM to the increased low idle set point, either as set or fixed within the programming of the one or more controllers 26 by the vehicle, engine, or controller manufacturer, or as input in second optional input step 106, and then to ninth operation step 136 wherein the one or more controllers 26 command the cooling fan clutch 44 to engage or remain engaged. The process then proceeds to fifth decision step 138, wherein the one or more controllers 26 determine whether the programmable and/or re-programmable length of time that any engine off key switch command will be ignored or overridden has been met, either as set or fixed within the programming of the one or more controllers 26 by the vehicle, engine, or controller manufacturer, or as input in fourth optional input step 110. If the programmable and/or re-programmable length of time that any engine off key switch command will be ignored or overridden has not been met, then the one or more controllers 26 continues to set the engine RPM to the increased low idle set point and to command the cooling fan clutch 44 to engage or remain engaged by returning to eighth operation step 134 and then to ninth operation step 136. If the programmable and/or re-programmable length of time that any engine off key switch command will be ignored or overridden has been met, then the one or more controllers 26 cause the engine to shut down at tenth operation step 140, and the process ends.

While the system and method for dissipating vehicle under hood heat accumulated during stationary engine operation at high load or RPM, increased engine operating temperature, increased individual component temperature, increased coolant temperature, and/or under high temperature ambient conditions has been described with respect to at least one embodiment, including a hardware protection mode, the system and method can be further modified within the spirit and scope of this disclosure. This application is therefore intended to cover any variations, uses, or adaptations of the system and method using its general principles. Further, this application is intended to cover such departures from the present disclosure as come within known or customary practice in the art to which the disclosure pertains and which fall within the limits of the appended claims.

What is claimed is:

1. A vehicle, comprising:

an engine positioned within an engine compartment;

a cooling system that recirculates coolant through the engine and through a radiator;

a cooling fan selectively driven by the engine by way of a cooling fan clutch;

at least one controller connected to the engine and to the cooling fan clutch;

the at least one controller being configured to determine whether a period of stationary engine operation occurs at least one of:

at or above a threshold engine load or RPM;

at or above a threshold engine operating temperature;

at or above a threshold individual component temperature;

at or above a threshold coolant temperature;

at or above a threshold ambient temperature; and for or longer than a threshold stationary engine operation duration; and; if so, the at least one controller being further configured to:

increase a low idle set point of the engine; and command the cooling fan clutch to engage or remain engaged;

for a cool-down period following the period of stationary engine operation.

2. The vehicle of claim 1, wherein:

the at least one controller being further configured to override an engine off key switch command for a length of time.

3. The vehicle of claim 2, wherein:

the at least one controller being further configured to deactivate the override of the engine off key switch in the presence of a high risk or priority engine fault.

4. The vehicle of claim 2, wherein:

at least one of:

the increased low idle set point;

the length of the cool-down period; and the length of time that the at least one controller is configured to override an engine off key switch command;

is programmable.

5. The vehicle of claim 1, wherein:

at least one of:

the threshold engine load or RPM;

the threshold engine operating temperature;

the threshold individual component temperature;

the threshold coolant temperature;

the threshold ambient temperature; and the threshold stationary engine operation duration is programmable.

6. The vehicle of claim 1, further comprising at least one of:

an Exhaust Gas Recirculation (EGR) system having an Exhaust Gas Recirculation Valve (EGRV), the at least one controller being further connected to the EGRV; and a power take-off (PTO), the at least one controller being further connected to the INTO.

7. The vehicle of claim 1, further comprising at least one of:

at least one under hood air temperature sensor, the at least one controller being further connected to the at least one under hood air temperature sensor;

at least one under hood individual component temperature sensor, the at least one controller being further connected to the at least one under hood individual component temperature sensor; and at least one coolant temperature sensor, the at least one controller being further connected to the at least one coolant temperature sensor.

8. A system for dissipating vehicle under hood heat accumulated during a period of stationary engine operation of a vehicle having an engine positioned within an engine compartment, and a cooling fan selectively driven by the engine by way of a cooling fan clutch, comprising:

at least one controller connected to the engine and to the cooling fan clutch, the at least one controller being configured to determine whether a period of stationary engine operation occurs at least one of:

at or above a threshold engine load or RPM;

at or above a threshold engine operating temperature;

at or above a threshold individual component temperature;

at or above a threshold coolant temperature;

at or above a threshold ambient temperature; and for or longer than a threshold stationary engine operation duration; and, if so, the at least one controller being further configured to:

increase a low idle set point of the engine; and command the cooling fan clutch to engage or remain engaged;

for a cool-down period following the period of stationary engine operation.

9. The system of claim 8, wherein:

the at least one controller being further configured to override an engine off key switch command for a length of time.

10. The system of claim 9, wherein:

the at least one controller being further configured to deactivate the override of the engine off key switch in the presence of a high risk or priority engine fault.

11. The system of claim 9, wherein:

at least one of:

the increased low idle set point;

the length of the cool-down period; and the length of time that the at least one controller is configured to override an engine off key switch command;

is programmable.

12. The system of claim 8, wherein:

at least one of:

the threshold engine load or RPM;

the threshold engine operating temperature;

the threshold individual component temperature;

the threshold coolant temperature;

the threshold ambient temperature; and the threshold stationary engine operation duration is programmable.

13. The system of claim 9, further wherein at least one of:

the at least one controller being further connected to an Exhaust Gas Recirculation Valve (EGRV) of an Exhaust Gas Recirculation (EGR) system of the vehicle; and the at least one controller being further connected to a power take-off (PTO) of the vehicle.

14. The system of claim 9; further comprising at least one of:

at least one under hood air temperature sensor, the at least one controller being further connected to the at least one under hood air temperature sensor;

at least one under hood individual component temperature sensor, the at least one controller being further connected to the at least one under hood individual component temperature sensor; and at least one coolant temperature sensor, the at least one controller being further connected to the at least one coolant temperature sensor.

15. A method of dissipating vehicle under hood heat accumulated during stationary engine operation of a vehicle having an engine positioned within an engine compartment; and a cooling fan selectively driven by the engine by way of a cooling fan clutch, comprising the steps of:

connecting at least one controller to the engine and to the cooling fan clutch;

configuring the at least one controller to determine whether a period of stationary engine operation occurs at least one of:

at or above a threshold engine load or RPM;

at or above a threshold engine operating temperature;

at or above a threshold individual component temperature;

at or above a threshold coolant temperature;

at or above a threshold ambient temperature; and for or longer than a threshold stationary engine operation duration; and, if so, further configuring the at least one controller to:

increase a low idle set point of the engine; and command the cooling fan clutch to engage or remain engaged;

for a cool-down period following the period of stationary engine operation.

16. The method of claim 15, further comprising the step of:

configuring the at least one controller to override an engine off key switch command for a length of time.

17. The method of claim 16, further comprising the step of:

configuring the at least one controller to deactivate the override of the engine off key switch in the presence of a high risk or priority engine fault.

18. The method of claim 16, wherein:

at least one of:

the increased low idle set point;

the length of the cool-down period; and the length of time that the at least one controller is configured to override an engine off key switch command;

is programmable.

19. The method of claim 15, wherein:

at least one of:

the threshold engine load or RPM;

the threshold engine operating temperature;

the threshold individual component temperature;

the threshold coolant temperature;

the threshold ambient temperature; and the threshold stationary engine operation duration is programmable.

20. The method of claim 15, further comprising at least one of the steps of:

providing at least one under hood air temperature sensor and connecting the at least one controller to the at least one under hood air temperature sensor;

providing at least one under hood individual component temperature sensor and connecting the at least one controller to the at least one under hood individual component temperature sensor; and providing at least one coolant temperature sensor and connecting the at least one controller to the at least one coolant temperature sensor.

* * * * *